United States Patent [19]

Karass

[11] Patent Number: 4,567,070

[45] Date of Patent: Jan. 28, 1986

[54] FIBROUS MATERIAL REINFORCING TAPE, METHOD OF MAKING THE SAME AND CONTAINERS REINFORCED BY SAID TAPE

[76] Inventor: Thomas J. Karass, 4645 Circle Rd., Montreal, Canada, H3W 1Z2

[21] Appl. No.: 633,046

[22] Filed: Jul. 20, 1984

[51] Int. Cl.[4] ..... B31B 1/72; B65D 25/00

[52] U.S. Cl. ..... 428/35; 428/343; 428/375; 493/116; 493/117

[58] Field of Search ..... 428/35, 343, 375; 493/111, 114, 116, 117; 206/344, 604–606

[56] References Cited

U.S. PATENT DOCUMENTS

| | | | |
|---|---|---|---|
| 1,883,938 | 9/1929 | Killeffer | 493/116 |
| 3,933,303 | 1/1976 | Kirby, Jr. | 206/141 |
| 3,994,432 | 11/1976 | Kirby, Jr. | 206/141 |
| 4,406,365 | 9/1983 | Kulig | 206/141 |

FOREIGN PATENT DOCUMENTS 889808 1/1972 Canada .

*Primary Examiner*—John E. Kittle
*Assistant Examiner*—James J. Seidleck

[57] ABSTRACT

In combination, a container made of sheets of fibrous material, said sheets adhered together by glue, and a tape for reinforcing at least part of said container, said tape adhered flat to said fibrous material over substantially its entire length, said tape having a thickness lying between 0.05 and 0.30 millimeters, said tape being weftless and made of parallel yarn ends, each made of several fibers selected from the group consisting of polyester, rayon and polyamide fibers, and an adhesive bonding said yarn ends together, each of said yarn end having gauge range from 100 to 12,000 deniers, there being up to 350 yarn ends in the tape, said yarn ends being flattened with their major cross-sectional dimension being greater than the diameter of the original round yarn ends used for making the tape by an amount varying between 35% and 100%, said adhesive filling the interstices between the yarn ends and providing a generally smooth surface at said main faces, said adhesive chosen to be compatible with said glue.

18 Claims, 17 Drawing Figures

FIBROUS MATERIAL REINFORCING TAPE, METHOD OF MAKING THE SAME AND CONTAINERS REINFORCED BY SAID TAPE

FIELD OF THE INVENTION

The present invention relates to weftless flexible tape made of polymeric material, to its method of manufacture and to various containers reinforced with said tape.

BACKGROUND OF THE INVENTION

Applicant's own prior Canadian Pat. No. 889,808, entitled: "STRAPPING" and issued Jan. 4, 1972, describes a reinforcing flexible weftless tape in which the individual strands or yarns are made of synthetic resin fiber yarns, such as polyamide, polyethylene, polypropylene and the like. The tapes obtained in accordance with this Patent are designed to replace steel strapping and are used around a container and tied by a buckle or the like. Another use of such tape is as cargo slings. Such tape is too thick to be permanently adhered to corrugated board or carton in high-speed folding cartons or corrugated cardboard-making machinery, so as to obtain permanentlyreinforced containers made of such materials.

OBJECTS OF THE INVENTION

It is therefore the general object of the invention to provide a weftless flexible tape made of yarn ends of polymeric material joined together in touching parallel relationship by an adhesive, said tape being sufficiently thin and the bonding agent being such that the tape can be fed along with the fibrous material into a high-speed folding carton or corrugated cardboard-making machinery, while being adhered to said fibrous material, using the same machinery.

Another object of the invention is to provide a tape of the character described, which is thin enough as to be inserted betwen the plies of corrugated cardboard and adhered to said plies, while forming only a very slight bulge at the exterior surface of the corrugated cardboard, thus allowing printing of said outside surface.

Another object of the invention is to provide an improved method for making such a thin, weftless tape.

Another object of the invention is to provide various types of containers reinforced with said tape.

Another object of the invention is to provide fibrous material container of reduced cost and improved strength due to the presence of the reinforcing tape in accordance with the invention.

Another object of the invention is to provide a reinforcing tape which can be accurately positioned within a fibrous material container and which does not slow down the manufacturing operations thereof.

SUMMARY OF THE INVENTION

The flexible weftless tape of the invention comprises a single ply of juxtaposed closely-adjacent parallel yarn ends, each made of several fibers selected from the group consisting of polyester, rayon and polyamide fibers and an adhesive bonding said yarn ends together, each yarn end having a gauge from 100 to 12,000 deniers, there being up to 350 yarn ends in the tape, the yarn ends being flattened with their greater dimensions parallel to the main faces of the tape, the adhesive filling the interstices between the yarn ends and providing a general smooth surface at the main faces of the tape, the adhesive being compatible with the glue used in making corrugated board, cartons and the like, the tape being such that it can be used in high-speed folding carton or corrugated cardboard-making machinery.

The method for making the flexible weftless tape comprises passing the separate yarn ends around a straight member to flatten the same; then passing the yarn ends through a bath of a water solution of a synthetic resin which is flexible when dry; subjecting the yarn ends to trans-axial pressure to compact and flatten the same whilst in the bath; then, when leaving the bath, bringing the yarn ends together weftwise to parallel touching relationship and under constant longitudinal tension; then exerting a scraping action successively on opposite main faces of said tape whilst still under tension; then drying said tape by application of heat; and then by being exposed to ambient air and further exerting a rolling trans-axial pressure on the tape before final winding of the tape. Preferably, while it is dried under heat, the tape is subjected to a progressively-increasing tension. The tape is used for reinforcing containers made of fibrous material. The tape is adhered flat to the fibrous material over substantially its entire length. Because the tape has sharp edges, it can be used a a rip tape without requiring the container to be scored or serrated. When the fibrous material is corrugated fiber board, the tape can be adhered between the corrugated layer and one of the flat layers.

DETAILED DESCRIPTION OF PREFERRED EMBODIMENTS

Figures 1, 2, 3:
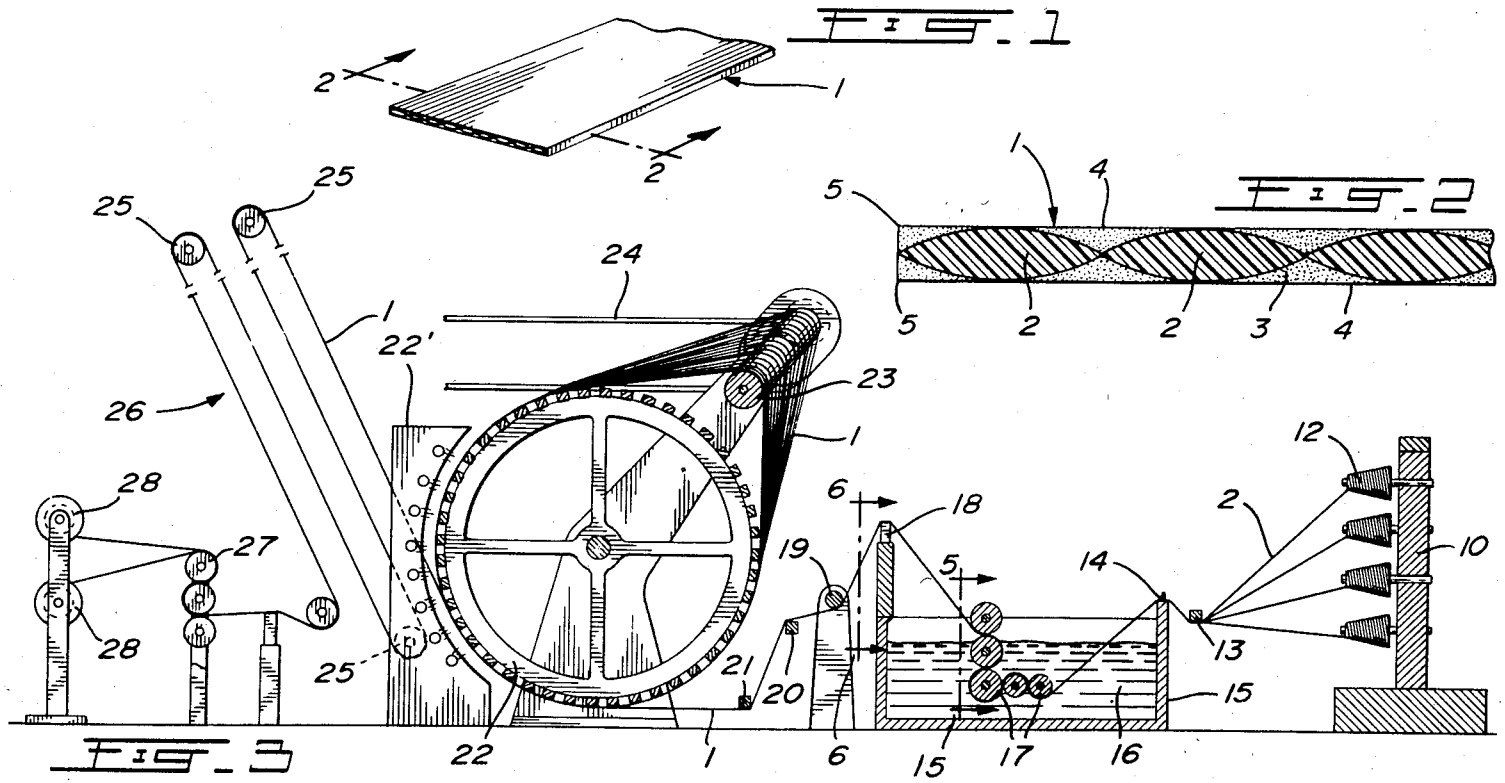
FIG. 1 is aschematic perspective view of the weftless tape of the invention.
FIG. 2 is a cross-section of the same, taken along line 2—2 of FIG. 2, but on an enlarged scale.
FIG. 3 is aschematic elevational view, mainly in section, of a preferred apparatus for carrying the tape-manufacturing method in accordance with the invention.
Figures 4, 5, 6:
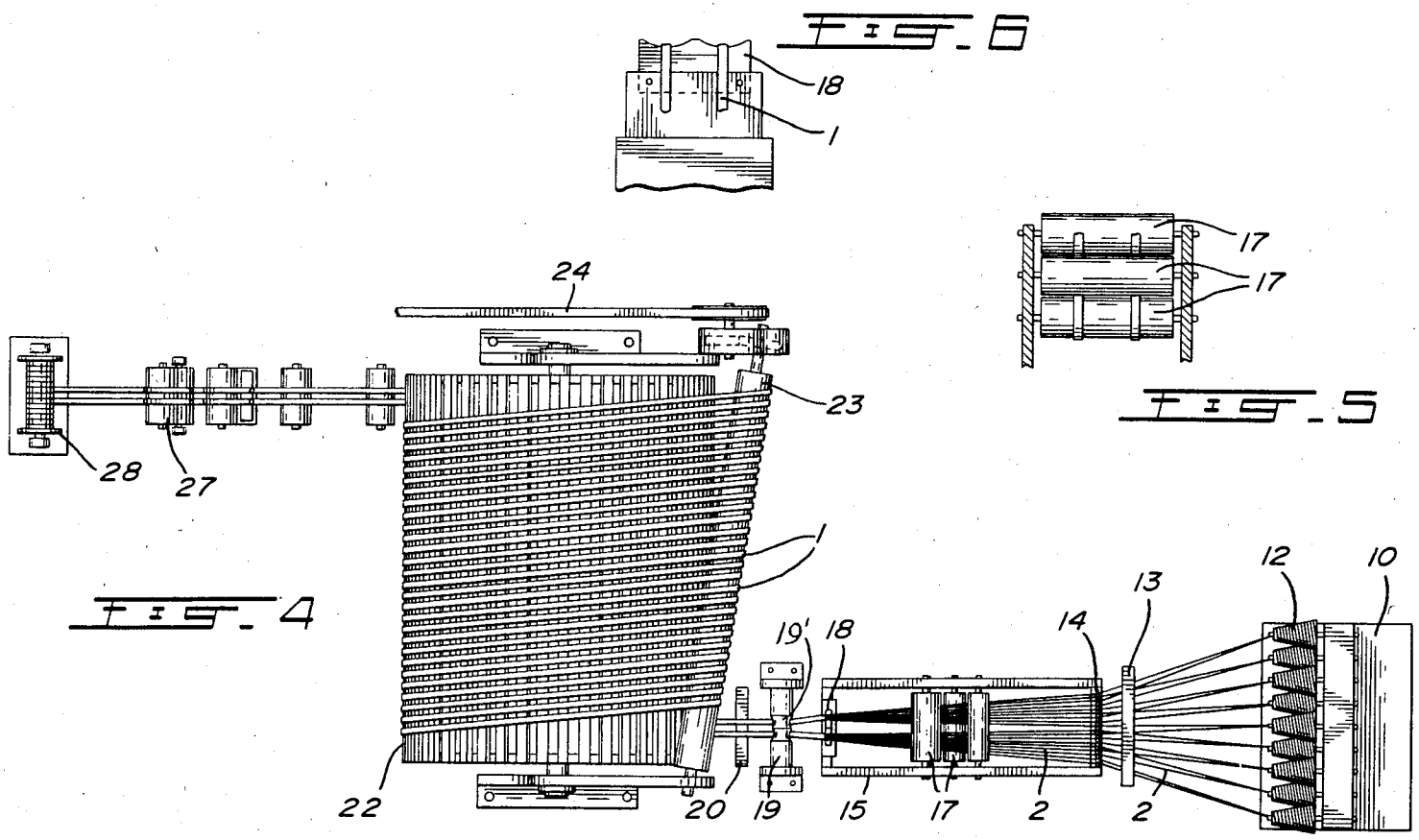
FIG. 4 is a top plan view of the apparatus shown in FIG. 3.
FIG. 5 is an enlarged detail view along line 5—5 of FIG. 3.
FIG. 6 is an enlarged view, taken along line 6—6 of FIG. 3.

The tape 1 of the invention, as illustrated in FIGS. 1 and 2, comprises, when ready for use, a single ply of several yarn ends 2, each made of several fibers selected from the group consisting of polyester, rayon and polyamide fibers, having a gauge between 100 and 12,000 deniers and being bonded together in juxtaposed closely-adjacent relationship by means of a bonding adhesive, indicated at 3, said adhesive filling the interstices between the yarn ends and providing, together with the yarn ends, a smooth surface at both main faces 4 of the tape 1. The tape, when finished, has sharp corners 5. It is characterized by its very small thickness, namely: between 0.05 and 0.30 millimeters and, preferably, between 0.15 and 0.20 millimeters. As clearly shown in FIG. 2, the yarn ends 2 are flattened with their major cross-sectional dimension parallel to the opposite main faces 4. The flattened yarn ends are wider than the diameter of the original yarn ends used for making the tape by an amount varying between 35% and 100% of said diameter. The bonding agent or adhesive 3 is such that it can be dissolved in water and that, when dried, it remains flexible and also is chosen to be compatible with the glue used in making corrugated board, cartons and the like and to the glue used for joining together portions of such fibrous materials.

Yarn ends and the adhesive are free of any wax. The apparatus used for making the tape in accordance with the invention is illustrated in FIGS. 3 to 6 inclusive.

Reference numeral 10 denotes a supply creel mounting bobbins 12 which supply individual yarn ends made, for example, of polyester, rayon or polyamide fibers. The individual yarn ends 2 are first passed under tension under a fixed, straight transverse bar 13, so that the yarns will pass around at least two edges of said bar 13 which will effect initial flattening of the yarn ends. The bar 13 is fixed below a comb 14 formed at the top edge of a basin 15. Thus, the individual yarns move upwardly from bar 13 to engage around the comb 14. This comb aligns the yarn ends in spaced-apart relationship. The yarn ends then move again under tension within a bath 16 within basin 15, said bath consisting of a water solution of, for instance, polyvinyl alcohol or polyvinyl acetate emulsion, said bath being free of any wax and, as noted above, being compatible with glue used in the trade for making corrugated cardboard and for adhering together panels of corrugated cardboard, single-ply carton and the like.

A plurality of pressure roller 17 are freely rotatable about parallel shafts disposed horizontally and transversely of basin 15. These pressure rollers are partially immersed in the bath, so that the individual yarns, still under tension, will move under and over the succeeding rollers and thus be subjected to trans-axial pressure while still in the bath, the solution having entirely coated the individual yarns before they reach the pressure rollers 17. While leaving the last pressure roller 17, which is outside of the bath 16, the individual yarns forming two groups are passed with each group over an arcuate concave guiding recess 18 upstanding from the top of basin 15. These guiding recesses 18 exert lateral pressure on the yarns to bring the individual yarns of each group close together in touching relationship. The action of the concave guiding recesses 18 acts on the individual yarn ends during all of their travel within the bath 15 from the comb 14, whereby the yarn ends of each group are progressively brought together into close relationship during said travel, as clearly shown in FIG. 4. From the concave recesses 18, the yarn ends 2 take a sharp downward direction to pass under and within the concave grooves 19' of a gathering and guiding member 19 fixedly mounted and of rounded cross-section; then over a straight bar 20 of square cross-section; then under a second straight bar 21, also of square cross-section. Bars 20 and 21 scrape off the adhesive from the main faces 4 of the tape and also further flattens the tape, since the tape is still under tension. The tape has now approximately the configuration as shown in cross-section in FIG. 2. It is then wound on a large diameter drying drum 22 and also on a tensioning and driving roller 23.

Roller 23 is positively driven through a driving belt 24 trained on the output pulley of a motor, not shown. Roller 23 is of uniform diameter throughout its length and its rotation axis is adjustable to make an angle of about 15 degrees with the rotation axis of the large diameter drum 22. Thus, drum 22 and roller 23 have diverging axes in the direction of the tape output of the drum and roller assembly. The tapes 1 are wound in spiral around both the drum 22 and roller 23 from the input end of the drum and roller assembly, starting from the straight bar 21. The tapes act as driving belts which rotate the drum 22. The arrangement also applies progressively-increasing linear tension to the tapes as they travel around the drum and roller assembly from the input to the output end. This arrangement also pulls the tapes through the bath 16 and around the bar, the comb 14, the pressure rollers 17, the guiding recessed plate 18, the guiding rod 19 and the straight bars 20 and 21. While travelling around the assembly of drum 22 and roller 23, the tapes are subjected to a source of heat to cure the adhesive 3, for instance an infra-red radiator 22'. The tapes are then cured in ambient air, that is at room temperature, by travelling around idle pulleys 25 in a zigzag path. The top and bottom pulleys 25 are spaced about 30 feet. If desired, an electricoperated group of cooling fans blow ambient air across the tapes in the direction of arrow 26. The tapes are then driven through finishing rolls 27 which apply further trans-axial pressure on the tapes. The tapes are then wound on spools, rolls or bobbins 28.

From the description of the foregoing apparatus, it is seen that the method for making the flexible thin weftless tape comprises feeding from a supply source up to 350 yarn ends, each made of several fibers of a material selected from the group consisting of polyester, rayon and polyamide; then passing said yarn ends around a straight member to flatten the same; aligning the threads or yarn ends in side-by-side relationship by passing through the comb 14; then passing the yarn ends while still separate from each other in a bath 16 of a water solution of a synthetic resin which is flexible when dry; keeping the yarn ends spaced apart to allow the water solution to fully cover each yarn end while in the bath; then subjecting the yarn ends to additional trans-axial pressure, that is by pressure rollers 17, to compact the yarn ends and flatten the same while still in the bath; then when leaving the bath, bringing the yarn ends together weftwise to parallel touching relationship by sliding lateral pressure and under constant longitudinal tension, this lateral pressure being applied by means of the recessed plate 18, then, while out of the bath, exerting a scraping action successively on the opposite main faces of the tape, that is by means of straight bars 20 and 21, which further flatten the yarn ends to final tape configuration, as shown in FIG. 2; then drying the tape by application of heat, that is, while the tape travels around the assembly of drum 22 and rollers 23, then further drying the tape by being exposed to ambient air, that is when the tapes travel around the pulleys 25, and then further exerting rolling trans-axial pressure on the tape before winding of said tape, that is through the pressure finishing rollers 27.

The method of the invention further comprises progressively increasing the tension of the tape while it is being dried under heat, this being accomplished by the angular relationship of roller 23 with respect to drum 22. The resulting tape 1 is of balanced construction and will not twist, and since the type of adhesive 3 used for its manufacture is compatible with the glue used in making cartons, corrugated boards and the like, the tape is suitable to be incorporated to the corrugated board or carton in high-speed folding carton or corrugated cardboard-making machinery.

Figure 7:
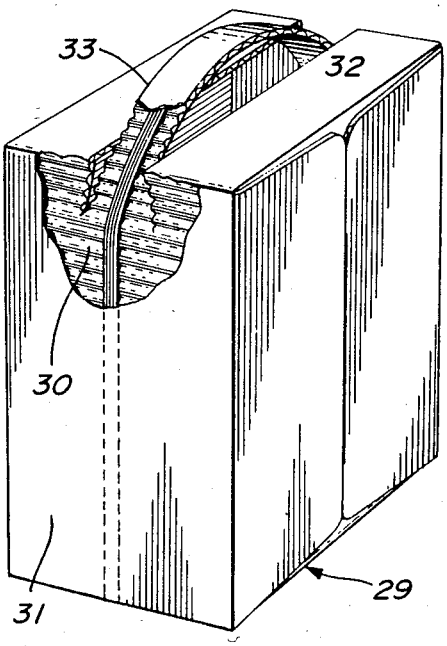
FIG. 7 is a perspective view, partially broken away, of a carrier container made of corrugated cardboard and incorporating the reinforcing tape.
Figure 8:
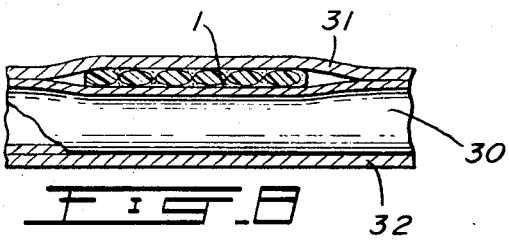
FIG. 8 is a partial cross-section of the tape and corrugated cardboard with the tape sandwiched between a flat and a corrugated layer of the corrugated cardboard.

FIG. 7 shows a carrier box or container for manually carrying a load, such as beer bottles or cans. This container, indicated at 29, is made of corrugated cardboard including a central corrugated layer 30, sandwiched between two flat layers 31 and 32, of, for instance, kraft paper. The container or box 29 is designed with an integral carrying handle 33 integrally attached to the container walls at its ends and made by forming a pair of parallel slits into the corrugated cardboard; as shown in FIG. 8, the tape is sandwiched between corrugated layer 30 and one of the flat layers 31,32. This is effected during the making of the corrugated cardboard and tape 1 is adhered to the adjacent layers with the same glue as used for directly adhering both layers 31, 32 to the corrugated layer 30. The tape is arranged to extend longitudinally of handle 33 and all around the box. The tape is adhered to the cardboard throughout its length. The tape is preferably inserted between the corrugated layer 30 and the external flat layer 31 of the box. Because the tape is very thin, it will not impair printing of the outside surface of the container.

Figure 11:
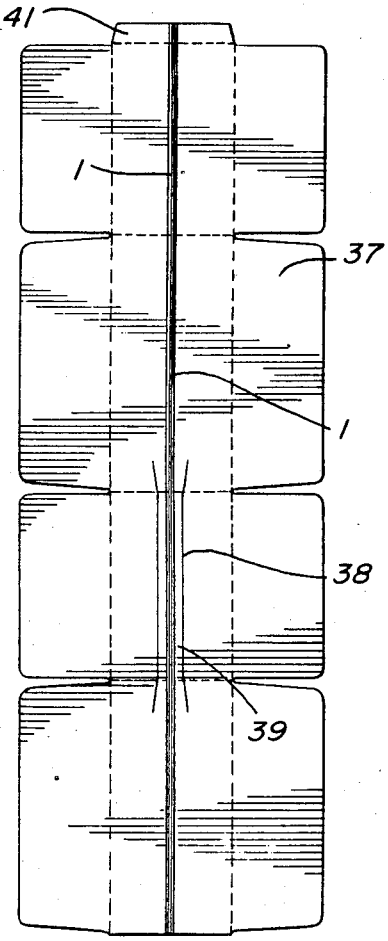
FIG. 11 is a plan view of the cutout blank of a folded carton provided with the reinforcing tape of the invention and incorporating a carrying handle.
Figure 9:
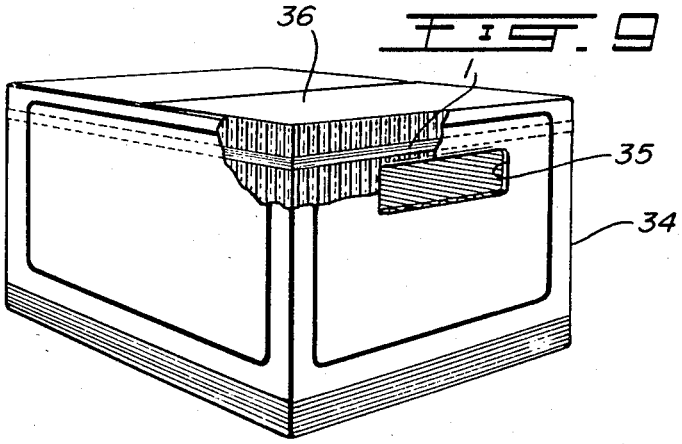
FIG. 9 is a perspective view of another corrugated cardboard-carrying container incorporating the reinforcing tape of the invention.
Figure 12:
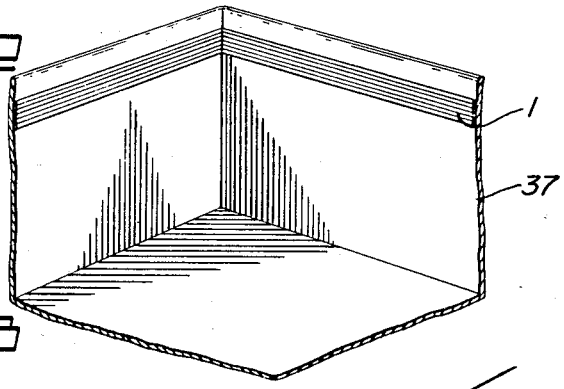
FIG. 12 is a partial perspective view of the carton of FIG. 11, in erected position.
Figure 13:
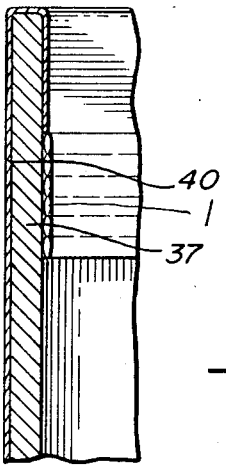
FIG. 13 is a cross-section of the upright wall of the carton of FIG. 12.

The tape will impart a much increased tensile strength to the handle 33, so that the latter will not tear at its ends. FIG. 9 shows another type of container, indicated at 34, in which handle means are provided by forming openings 35 at opposite side walls of the box. In this case, the tape 1 is also incorporated into the corrugated cardboard in the manner shown in FIG. 8; but is arranged to extend around the four side walls of the box just above the handle openings 35 in a plane parallel to the top wall 36 of the box and between said top wall 36 and handle openings 35. The tape 1 thus prevents tearing of the cardboard material along the top edge of the handle openings 35 under the load carried by the box. Tape 1 can also be adhered to single-ply carton, such as the carton 37 shown in FIGS. 11, 12, and 13. The tape is applied to the inside surface of the finished erected container. It is adhered to the carton while the same is being die-cut to form the blank, as shown in FIG. 11. Such a blank may be provided with the slits 38 to form an integral handle 39 which will be strong enough with the tape 1 extending along the handle. The carton layer 37 can be covered with kraft paper 40, as shown in FIG. 13, if so desired. Tape 1 can also be used as a rip tape to rip a box or container open without requiring any scoring of the corrugated cardboard or carton material.

Figure 10:
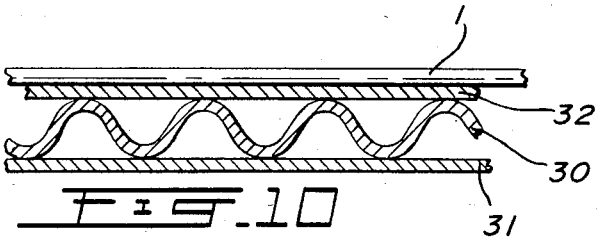
FIG. 10 is a longitudinal view of the tape adhered to the outside of the flat layer of a corrugated cardboard, with the tape used as a rip tape.
Figure 14:
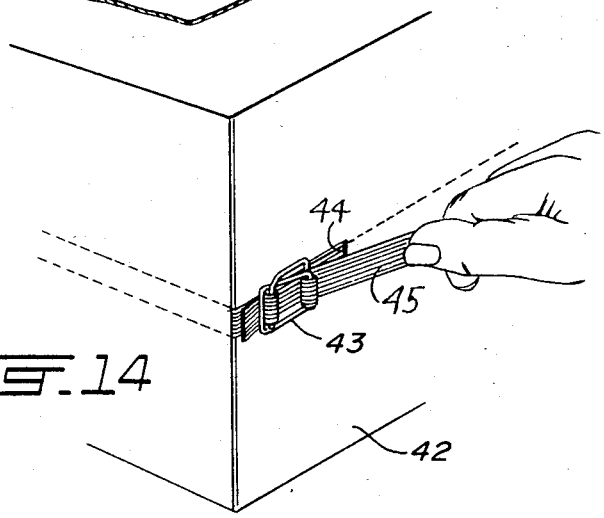
FIG. 14 is a perspective view of part of a container provided with the reinforcing tape of the invention, along with a tightening strap connector to provide means to prevent bulding of the container under its load.

FIG. 10 shows a cross-section of the corrugated cardboard with the tape 1 adhered to the internal surface of the cardboard. Supposing a corrugated cardboard forms a blank, such as shown in FIG. 11 with the tape extending to the tab 41 of the blank and with the tab disposed on the outside of the box when the blank has been folded and erected into a box, it will be understood that by simply pulling on the tab 41 in the region of the tape, in a direction away from the wall of the box and in a direction to fold the tape on itself, the box will easily rip open. Thus, the tape is used not only for reinforcement but for ripping purposes. Obviously, the tape can be used on a single-layer carton also as a rip tape in the same manner as just explained. The tape can be used to prevent bulging of the container walls under the load of its contents. The tape can then be disposed mid-way between the top and bottom walls of the container. Furthermore, the tape can be arranged so as to be tightened around the box, as shown in FIG. 14. For this purpose, if the box or container 42 of FIG. 14 is a carton, the tape 1 is made to protrude at both ends from a corner of said carton and attached together by means of a buckle or strap connector, shown at 43, and as of the type described in Canadian Pat. No. 688,834 and dated June 16, 1964 in the name of Canadian Ribbon Tape Company Limited. This strap connector permits tightening of the tape around the box and maintaining the tape in tightened condition. When the box is a carton with the tape on the inside surface of the container, it is a simple matter to provide an opening for the issuance of the tape.

When the box is made of corrugated cardboard and the tape sandwiched between the outer flat layer 31 and the corrugated layer 30, as in FIGS. 7, 8, and 9, the external layer 31 is cut out as shown at 44, to permit protrusion of the tightening end 45 of the tape.

Figure 15:
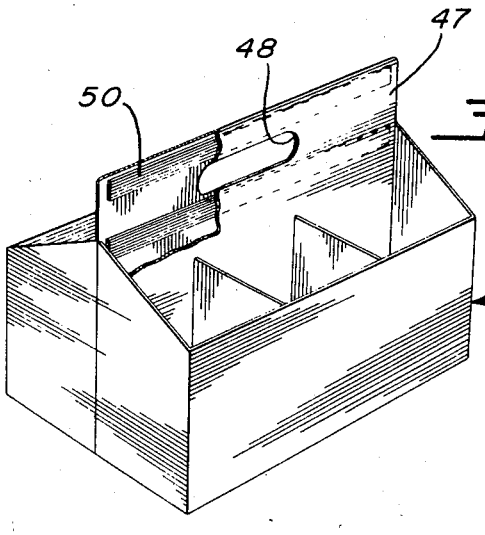
FIGS. 15, 16, and 17 are perspective view of different additional types of containers in which the handle or container-grasping part is reinforced with the tape of the invention.
Figure 16:
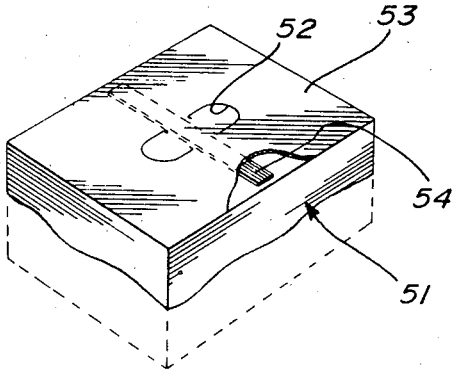
Figure 17:
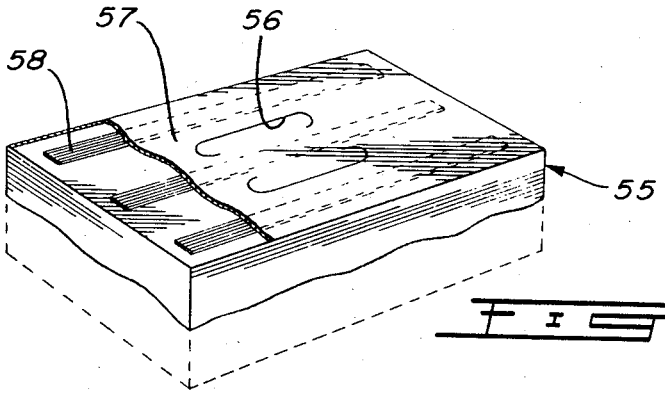

FIGS. 15, 16, and 17 show other embodiments of the containers of the invention in which only a portion of the container is reinforced with tape 1. FIG. 15 shows a bottle carrier 46 made of single-ply carton having an upstanding double-layer handle flap 47 provided with a handle opening 48. As shown, the area of the carton around the handle opening 48 is reinforced by the tape in accordance with the invention, there being provided a length of tape 50 alongside both the top and bottom edges of opening 48. The tape lengths 50 are entirely adhered to the inside of the two layers of flap 47 and, therefore, are not visible from the outside for aesthetic purposes. Tape ends 50 reinforce the handle flap 47 at its weak points, especially at the ends of handle opening 48.

With this arrangement, it is possible to provide a bottle carrier which, for the same load, uses cardboard material of about half the strength of the cardboard material normally used for such bottle carriers, but without the tape lengths 50. This embodiment also shows that it is not necessary for all applications to extend tape 1 completely around the box or container. For certain applications, it is only sufficient to apply the tape only to selected parts of the container which are subjected to the heaviest stress.

FIG. 16 shows the same idea applied to a container 51 having openings 52 in its top wall 53 for the insertion of fingers to grasp and carry the loaded container. In this case, tape 1 is in the form of tape length 54 applied to the underface of the top wall 53 and running transversely of the container 51 between the two openings 52.

FIG. 17 shows another container 55 with partial tape reinforcement. In this case, the top wall 57 of container 55 is provided with two handle openings 56 and the fibrous material area around said openings is reinforced by means of three tape lengths 58 extending longitudinally of the container on the outside of each opening 56 and between said openings, respectively.

What I claim is:

1. In combination, a container made of sheets of fibrous material, said sheets adhered together by glue, and a tape for reinforcing at least part of said container, said tape adhered flat to said fibrous material over substantially its entire length, said tape having a thickness lying between 0.05 and 0.30 millimeters, said tape being weftless and made of parallel yarn ends, each made of several fibers selected from the group consisting of polyester, rayon and polyamide fibers, and an adhesive bonding said yarn ends together, each said yarns end having a gauge range from 100 to 12,000 deniers, there being up to 350 yarn ends in the tape, said yarn ends being flattened with their major cross-sectional dimension parallel to the opposite main faces of the tape, said major cross-sectional dimension being greater than the diameter of the original round yarn ends used for making the tape by an amount varying between 35% and 100%, said adhesive filling the interstices between the yarn ends and providing a generally smooth surface at said main faces, said adhesive chosen to be compatible with said glue.

2. A container as defined in claim 1, having an elongated handle integral with the container at its ends and formed by a pair of parallel slits made in said container, wherein said tape extends along and is adhered to said handle and also to portions of said container adjacent both ends of said handle.

3. A container as defined in claim 1, having a top wall, a bottom wall, side walls, end walls and elongated handle openings made in said end walls and lying in a plane substantially parallel to said top and bottom walls, wherein said tape extends transverse to said side and end walls in a loop and in a plane substantially parallel to said top and bottom walls and located intermediate said top wall and said handle opening.

4. A container as defined in claim 1, having a top wall, a bottom wall, side walls and end walls, wherein said tape extends in a loop transverse to said side and end walls in a plane intermediate and substantially parallel to said top and bottom walls, said tape having opposite end portions exposed at the exterior of said containerand adapted to overlap each other exteriorly of said container, and a tape connector engaged by said end portions for interconnecting said end portions and maintaining the tape in tightened condition around the container.

5. A container as defined in claim 4, wherein said tape end portions and said tape connector are located at a corner of said container defined by the junction of an end wall with a side wall.

6. A container as defined in claim in claim 1, 2 or 3, wherein said fibrous material forms a single-ply carton and said tape is directly adhered to said carton.

7. A container as defined in claim 4 or 5, wherein said fibrous material forms a single-ply carton and said tape is directly adhered to said carton.

8. A container as defined in claim 1, 2 or 9, wherein said container has an interior surface and said tape is directly adhered to said interior surface.

9. A container as defined in claim 4 or 5, wherein said container has an interior surface and said tape is directly adhered to said interior surface.

10. A container as defined in claim 1, 2 or 3, wherein said fibrous material forms a corrugated cardboard including a corrugated layer sandwiched between and adhered to a pair of flat layers, said tape sandwiched between and adhered to said corrugated layer and one of said flat layers.

11. A container as defined in claim 4 or 5, wherein said fibrous material forms a corrugated cardboard including a corrugated layer sandwiched between and adhered to a pair of flat layers, said tape sandwiched between and adhered to said corrugated layer and one of said flat layers.

12. A container as defined in claim 1, 2 or 3, wherein said fibrous material forms a corrugated cardboard including a corrugated layer sandwiched between and adhered to a pair of flat layers, one of said flat layers disposed at the exterior of said container, said tape sandwiched between and adhered to said corrugated layer and to said one flat layer.

13. A container as defined in claim 4 or 5, wherein said fibrous material forms a corrugated cardboard including a corrugated layer sandwiched between and adhered to a pair of flat layers, one of said flat layers disposed at the exterior of said container, said tape sandwiched between and adhered to said corrugated layer and to said one flat layer.

14. A container as defined in claim 1, wherein said fibrous material forms a corrugated cardboard including a corrugated layer sandwiched between and adhered to first and second flat layers, said first and second layers disposed at the interior and at the exterior of said container, respectively, said tape having sharp edges and adhered to said first layer inwardly of said container and having an end portion capable of being grasped from the exterior of said container, said tape serving to rip said container open along said tape by pulling on said end portion away from said container and in a direction causing folding of said tape.

15. A container as defined in claim 1, wherein said fibrous material forms a single-ply carton, said tape having sharp edges and adhered to said carton inwardly of said container and having an end portion capable of being grasped from the exterior of said container, said tape serving to rip said container open along said tape by pulling on said end portion away from said container and in a direction causing folding of said tape.

16. A container as defined in claim 1, further including an integral flap protruding from the top of said container, a handle opening made in said flap and at least one length of said tape adhered to said flap between the top edge thereof and said handle opening.

17. A container as defined in claim 1, having a top wall with a pair of spaced holes made therethrough and serving as grasping means for carrying said container, and said tape being in the form of a tape length adhered to said top wall and extending between said two spaced openings.

18. A container as defined in claim 17, further having additional lengths of said tape adhered to said top wall and extending exteriorly of the respective openings relative to said first-named tape length.

* * * * *